US005772711A

United States Patent [19]

Kieffer

[11] Patent Number: 5,772,711

[45] Date of Patent: Jun. 30, 1998

[54] FILTER BLOCKAGE WARNING INDICATOR

[75] Inventor: Joseph W. Kieffer, Rogers, Minn.

[73] Assignee: Wagner Spray Tech Corporation, Minneapolis, Minn.

[21] Appl. No.: 753,830

[22] Filed: Dec. 2, 1996

Related U.S. Application Data

[62] Division of Ser. No. 498,739, Jul. 6, 1995, Pat. No. 5,639, 222.

[51] Int. Cl.[6] ..... B01D 35/143

[52] U.S. Cl. ..... 55/274; 55/471; 95/19; 95/25; 417/63

[58] Field of Search ..... 55/274, 471, 467; 95/25, 19; 60/39.092; 417/63, 244

[56] References Cited

U.S. PATENT DOCUMENTS

| | | | |
|---|---|---|---|
| 1,959,759 | 5/1934 | Hultberg | 55/274 |
| 3,611,337 | 10/1971 | Balzer et al. | 55/274 X |
| 4,158,449 | 6/1979 | Sun et al. | 60/39.092 X |
| 4,492,151 | 1/1985 | Mattei | 55/274 X |
| 4,751,501 | 6/1988 | Gut | 55/274 X |
| 4,859,218 | 8/1989 | Trias | 55/274 X |
| 5,148,669 | 9/1992 | Sellakumar | 60/39.092 |
| 5,272,866 | 12/1993 | Nieminen | 60/39.092 X |
| 5,496,393 | 3/1996 | Otsuka et al. | 95/19 |
| 5,505,753 | 4/1996 | Heysek | 55/274 |
| 5,639,222 | 6/1997 | Kieffer | 417/244 |

*Primary Examiner*—Richard L. Chiesa
*Attorney, Agent, or Firm*—Faegre & Benson

[57] ABSTRACT

Apparatus for indicating when the air intake filter of portable turbines useful with spray paint guns is blocked and a method and apparatus for close coupled mounting of a pair of series connected turbines by axially aligning and abutting the axial outlet of one turbine against the axial inlet of the other turbine with a seal surrounding the turbine junction and with tie rods extending between radially projecting apertured ears of the turbines securing the turbines together and supporting the turbines on a generally U-shaped mounting bracket having spaced apart flanges engaging the tie rods. An air baffle partitions the space containing the two turbines into two air plenums to prevent hot air exhausted by the larger turbine from entering the air inlet to the turbine impellers. A visual or audible indicator provides a perceptible indication that the filter is becoming blocked.

11 Claims, 6 Drawing Sheets

FILTER BLOCKAGE WARNING INDICATOR

CROSS-REFERENCE TO RELATED APPLICATION

This is a division of application Ser. No. 08/498,739, filed Jul. 6, 1995, now U.S. Pat. No. 5,639,222.

BACKGROUND OF THE INVENTION

This invention relates to a filter blockage warning indicator for turbines used with paint-spraying equipment, particularly high volume low pressure (HVLP) air-atomization-assisted paint spray guns.

It has been found preferable to provide a visual indication when an air intake filter is partially blocked, as will occur due to the accumulation of particulates in the filter during operation. Visual indication of a blocked filter is provided by a warning lamp which has leads connected in series with a vacuum actuated switch.

DETAILED DESCRIPTION OF THE INVENTION

Figure 1:
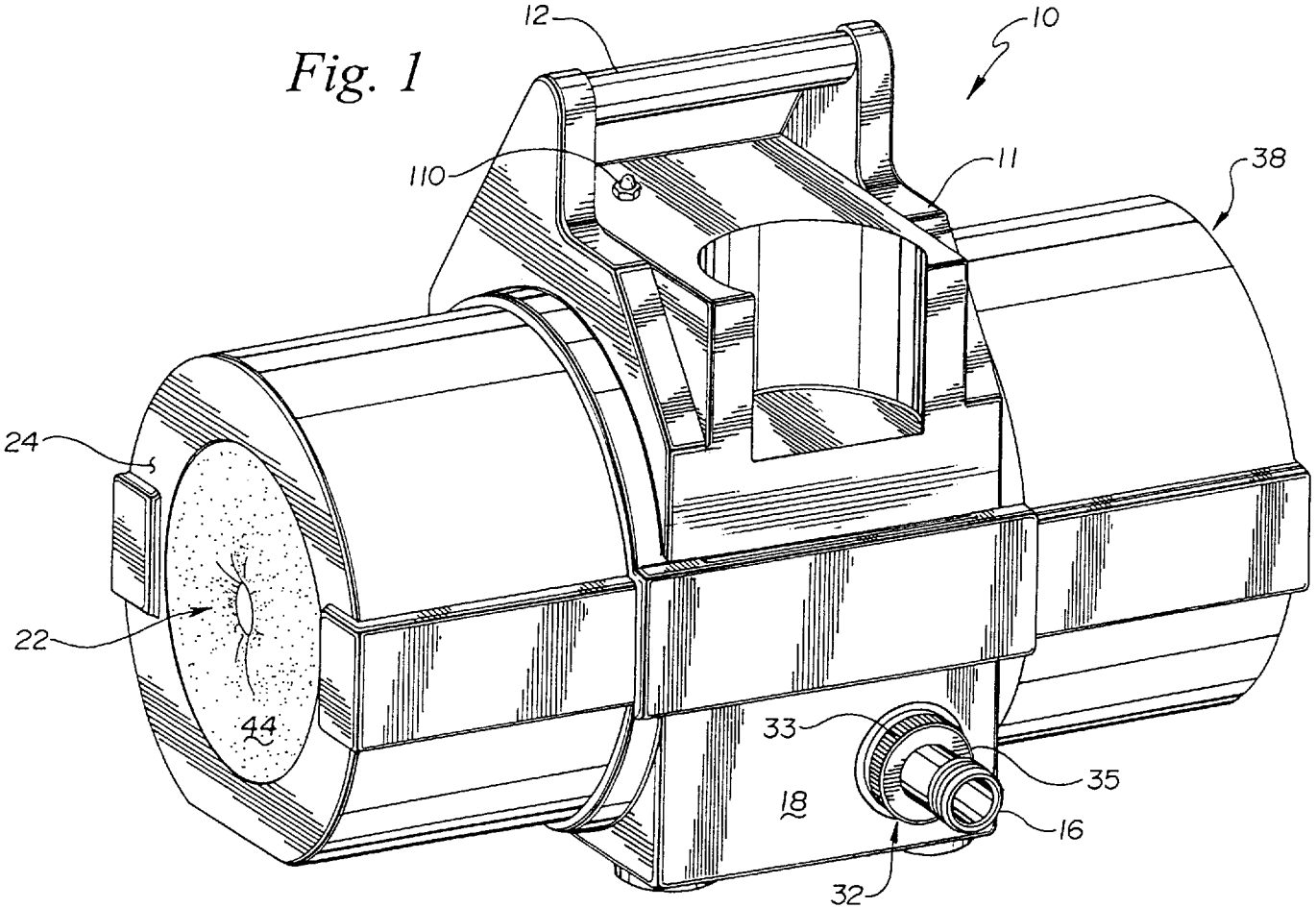
FIG. 1 is a perspective view of a turbine assembly useful in the practice of the present invention.

Referring now to the Figures, and particularly to FIG. 1, a turbine assembly 10 includes a turbine housing 11. It is to be understood that turbine housing 11 houses a pair of turbines 40, 41 and is portable, evidenced by handle 12, and preferably has a pair of air intake filters 14 and a pressurized air outlet 16. First turbine 40 is preferably a 5.7" single stage reverse axial flow turbine as available from Ametek, Lamb Electric Division of Kent, Ohio. Second turbine 41 is preferably a four stage, tangential discharge 5.7" diameter turbine similar to Model 117197 also available from Ametek.

Figure 2:
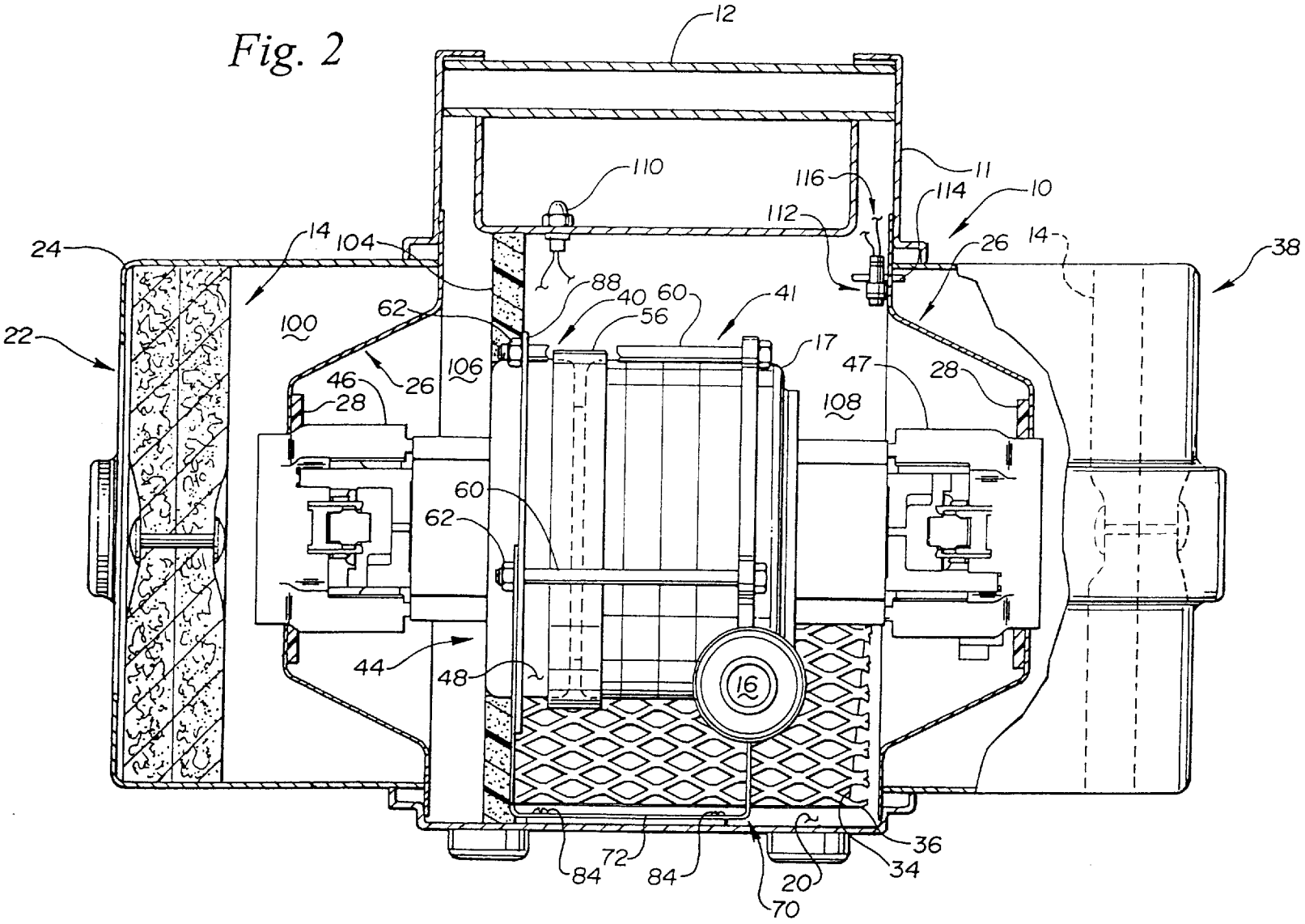
FIG. 2 is a simplified elevation view of the assembly of FIG. 1 in section to show the close coupled series mounting arrangement for first and second turbines according to the present invention.
Figure 3:
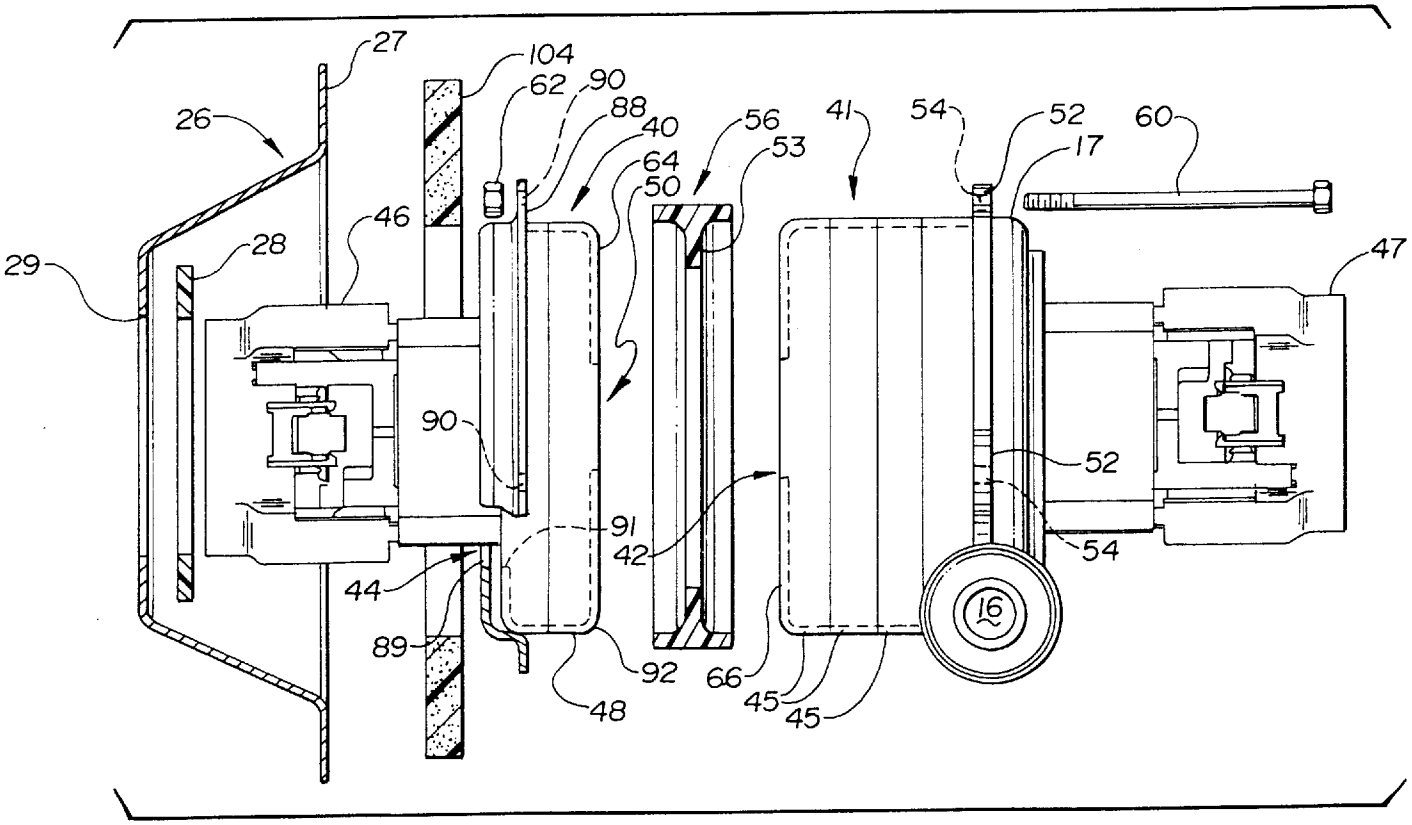
FIG. 3 is an exploded view of the first and second turbine mounting arrangement together with certain associated parts of FIG. 2.

Air outlet 16 is preferably connected via an air hose (not shown) to a hand-held paint spray gun (not shown) such as an HVLP type which uses air to atomize paint. Referring now also to FIGS. 2 and 3, air outlet 16 is formed integrally with an enclosure 17 of the second turbine 41 which enclosure is preferably an aluminum die casting.

A first side wall 18 of housing 11 has an aperture through which air outlet 16 projects. Air outlet 16 of turbine 41 is secured in wall 18 by a decorative ring 32 which may have a knurled surface 33 at its periphery 35 to aid in rotating ring 32 onto air outlet 16 during assembly. A second side wall 20 is located opposite the first side wall 18 and preferably has a cutaway portion 34 covered by a screen 36, as shown in FIG. 2.

A first air intake 22 at a first end 24 of housing 11 provides for air to enter housing 11 through filter 14. The air entering air intake 22 is drawn into a motor 46 and then delivered to the impeller intake 44 of turbine 40. Air entering the impeller intake 44 is delivered to impeller stage 48 where it is compressed (when motor 46 is energized) and thereafter exits an axial air outlet 50, it being understood that turbine 40 is an axial reverse flow type turbine, preferably having a diameter equal to the diameter of the second turbine 41.

Air exiting air outlet 50 is sealed by an air seal such as resilient annular seal 56 having a T-shaped cross section 53. Air exiting outlet 50 is thus constrained to enter an axial air inlet 42 of turbine 41 thus forming a close-coupled turbine junction. The air is compressed in turbine 41 (when motor 47 is energized) and thereafter exits at air outlet 16. Seal 56 is preferably made of silicone rubber or other similar resilient material suitable for forming an air-tight seal for the junction between turbines 40 and 41. Since the outlet 50 of the first turbine 40 and the inlet 42 of the second turbine 41 are each located in respective planar surfaces 64, 66 of the turbine impeller housings of turbines 40, 41 and the planar surfaces 64, 66 are parallel and closely spaced, a more efficient air path is created and a smaller, lighter, more efficient turbine housing 11 may be used.

It is to be understood that at certain times it is desirable to energize only one of turbines 40, 41 to provide for reduced air flow or air pressure at outlet 16, or to reduce the amount of electrical power drawn by turbine assembly 10. For example, it is desirable to reduce air flow and pressure when providing air to atomize a low viscosity liquid such as typical wood stain. In such event the deenergized turbine provides a relatively unrestricted path to allow the air to pass therethrough to air outlet 16. Using different sized turbines allows a choice of air flows and pressures, with a relatively low air flow and pressure available with only turbine 40 energized, an intermediate air flow and pressure with only turbine 41 energized, and a relatively high air flow and pressure with both turbines 40 and 41 energized. Holding flow constant at 15 SCFM for ease of comparison, the desired pressure levels are 2 PSI with only turbine 40 energized, 5 PSI with only turbine 41 energized, and 7 PSI with both turbines 40 and 41 energized. It is to be understood, of course, that the air flow will likely change with changes in the selection of turbines energized, but will also vary with changes in configuration, such as air hose length and diameter and air cap conditions (e.g. with or without pattern adjusting air flowing through the air cap on the gun).

Returning now to FIG. 2, a second air intake at a second end 38 of turbine housing 11 provides for cooling air to enter housing 11 and cool the second turbine motor 47 with that cooling air exiting through cutaway portion 34.

Referring now most particularly to FIGS. 2 and 3, turbine 40 may be snugly received in a stepped annular flange member 88 having a central opening 89 and a plurality of peripheral mounting apertures 90. Central opening 89 is as large or larger than an opening 91 in turbine casing 92 which forms impeller intake 44.

Figure 4:
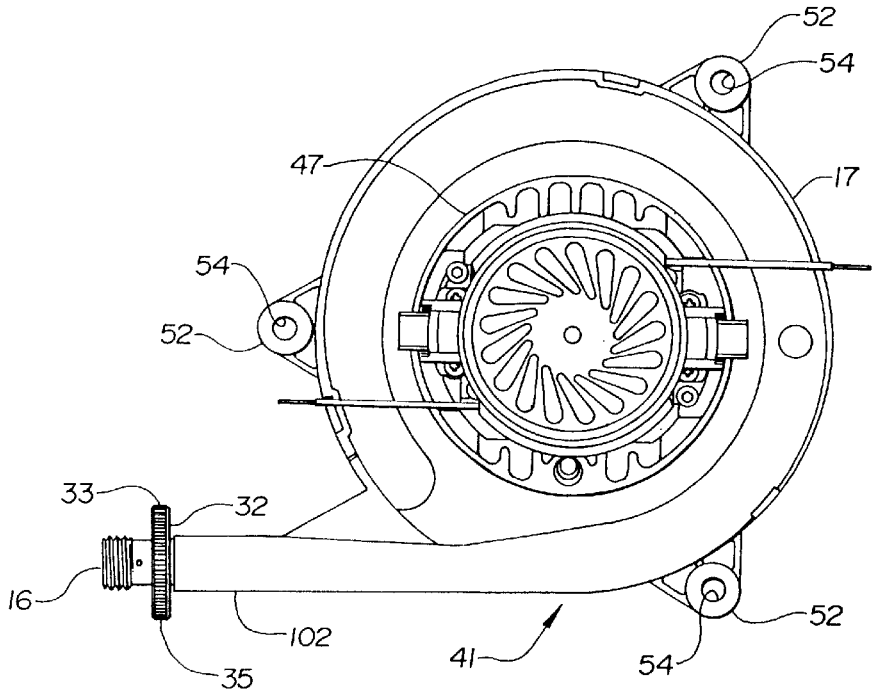
FIG. 4 is a rear elevation view of the second turbine of FIG. 2.
Figure 5:
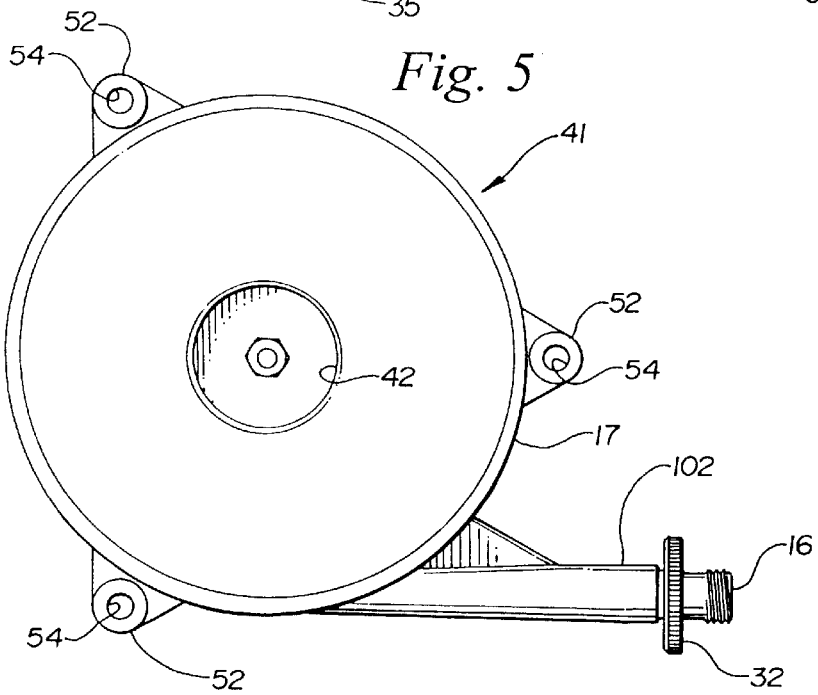
FIG. 5 is a front elevation view of the second turbine of FIGS. 2 and 4.

Referring now also to FIGS. 4 and 5, turbine 41 has a plurality of radially projecting ears 52 disposed about its periphery as may be seen most clearly in FIGS. 4 and 5. Each of ears 52 have a mounting aperture 54 therethrough and it is to be understood that the peripheral mounting apertures 90 in the flange member 88 of turbine 40 are axially aligned with the mounting apertures 54 in ears 52 of turbine 41. A tie rod or bolt 60 is received in each pair of respectively aligned mounting apertures 54, 90 as shown most clearly in FIG. 2. A fastener such as a mating nut 62 is preferably received on the end of each tie rod 60 and the tie rods 60 are drawn up to hold turbines 40, 41 axially together with seal 56 interposed therebetween to prevent air leakage to atmosphere at the interface between the air outlet 50 of turbine 40 and air inlet 42 of turbine 41. It is to be understood that turbine 40 may also be provided with radially extending ears similarly to turbine 41, as an alternative to flange member 88.

As may be seen in FIGS. 2 and 3, each of motors 46, 47 extend in axially opposite directions and each is preferably supported by an annular ring or drive motor support flange 26 and sealed by a washer-like annular seal 28. Each of seals 28 is preferably made of closed-cell urethane foam or equivalent material. Each ring 26 is preferably a sheet metal stamping in the form of a dish or bowl with an aperture 29 therein concentric to and preferably congruent with the outer surface of motor 46 (or 47) to both support and seal the motor at the edge of aperture 29. It is to be understood that an outer flange or periphery 27 of ring 26 may be secured to housing 11 in any conventional manner, as for example by conventional fastening means (not shown) or by a conventional interfitting relationship between rings 26 and housing 11 preventing relative movement therebetween when assembled.

Referring now again most specifically to FIGS. 4 and 5, turbine 41 has an air inlet 42 and a plurality of stages 45 to compress air before delivering it to air outlet 16. It is to be understood that turbine 41 is powered by an electric motor 47, in a manner similar to that for turbine 40. An extension 102 projects generally tangentially from the die cast turbine enclosure 17. Decorative ring 32 may be used to secure extension 102 to wall 18, it being understood that the aperture in wall 18 is of a diameter less than the diameter of extension 102.

Figure 6:
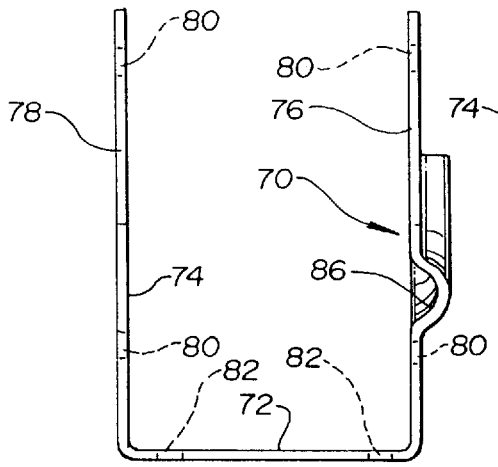
FIG. 6 is a side elevation view of a mounting bracket for the series connected turbine mounting arrangement of the present invention.
Figure 7:
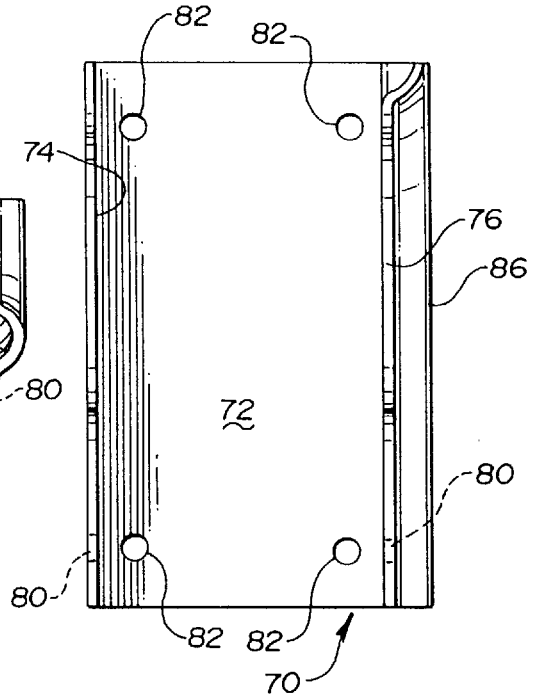
FIG. 7 is a top plan view of the bracket of FIG. 6.
Figure 8:
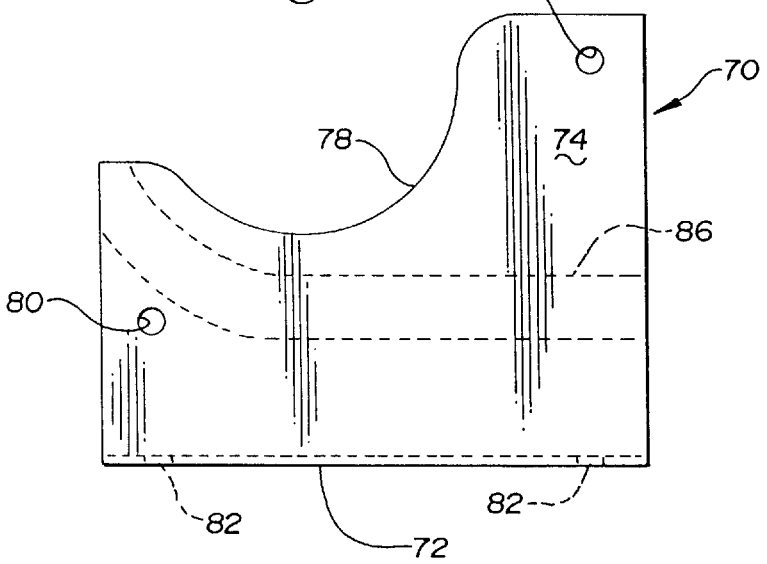
FIG. 8 is an end elevation view of the bracket of FIGS. 6 and 7.

Referring now also to FIGS. 6, 7 and 8, as well as FIG. 2, a mounting bracket 70 for the close coupled turbine mounting arrangement may be seen. Mounting bracket 70 preferably has a planar base portion 72 and spaced-apart upstanding end portions or flanges 74, 76 forming a U-shape overall for bracket 70 when viewed from the side, as illustrated in FIGS. 2 and 6. Each end portion 74, 76 has a cutaway relief or contoured edge 78 preferably congruent, and in any event providing clearance with a mating surface of each of the first and second turbines 40, 41 to accommodate motors 46, 47. Each of upstanding flanges 74, 76 has a pair of apertures 80, with each aperture 80 aligned or coaxial with a pair of mounting apertures 54, 90 in turbines 40, 41. As may be seen most clearly in FIG. 2, the end portions or upstanding apertured flanges are spaced apart a distance corresponding to the distance between the mounting apertures 54, 90 of the first and second turbines 40, 41. The tie rods 60 pass through each flange 74, 76 to secure the first and second turbines 40, 41 to the mounting bracket 70. Bracket 70 further preferably has a plurality of holes or apertures 82 in base portion 72 used in connection with fasteners 84 such as screws (see FIG. 2) to secure bracket 70 to housing 11. Bracket 70 further has a relieved track or groove 86 to accommodate the curvature of die cast turbine housing 17 and extension 102 of turbine 41.

Figure 9:
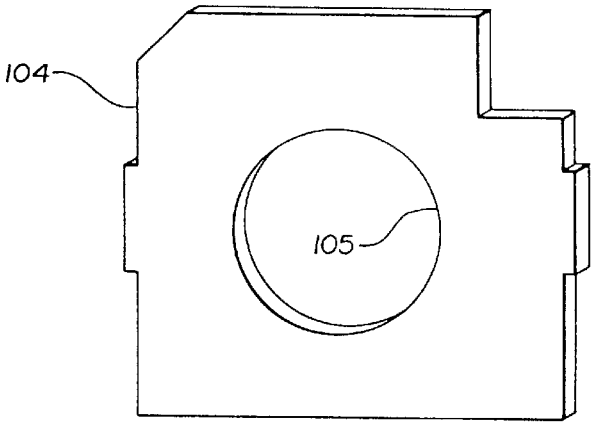
FIG. 9 is a perspective view of a foam air baffle useful in the practice of the present invention.

Referring now to FIGS. 2, 3 and 9 an air baffle 104 preferably formed of closed cell foam divides the interior space between annular rings 26 into two air plenums 106, 108 as shown in FIG. 2. Air baffle 104 preferably has a bore 105 therethrough sized to provide a snug (and therefore generally air-tight) fit with the flange 88 (or casing 92) of turbine 40. The outer perimeter of baffle 104 is similarly sized to provide a snug, generally air-tight fit with housing 11, thus forming an air plenum 106. Air plenum 106 extends from ring 26 surrounding motor 46 to the air baffle 104 and permits air therein to enter impeller intake 44 of turbine 40. Air plenum 108 extends from ring 26 surrounding motor 47 to air baffle 104 and provides an exhaust path for the air passing over motor 47 to exit opening 34 in wall 20. It has been found desirable to exhaust the relatively hot exhaust air used to cool motor 47 through screen 36 to keep such heated air from being able to directly enter the impeller intake 44. It is to be understood that motor 46 operates substantially cooler than motor 47, because the load of turbine 40 is substantially less than the load of turbine 41. Thus only relatively cool air will enter air inlet or intake 44, whether motor 46 is energized or not.

Figure 10:
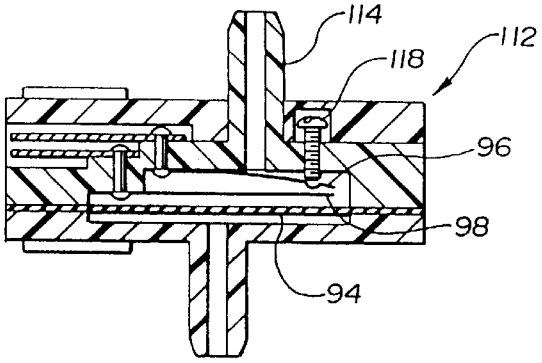
FIG. 10 is a section view of a vacuum switch useful in the practice of the present invention.

Referring now to FIGS. 2 and 10, it has been found preferable to provide a visual indication when the air intake filter 14 is partially blocked, as will occur due to the accumulation of particulates in the filter during operation. Visual indication of a blocked filter is provided by a warning lamp 110, which has leads 111 preferably connected in series with a vacuum actuated switch 112. Switch 112 is preferably a series 500 switch available from Micro Pneumatic Logic, Inc. of 2890 Northwest 62nd Street, Fort Lauderdale, Fla., modified to include a teflon diaphragm 94 to extend switch point stability over a broader temperature range. Switch 112 is preferably mounted in ring 26 supporting motor 47 and has a sensor port 114 projecting through ring 26 to sense the presence or absence of a vacuum condition in an air space 100 between filter 14 and ring 26 at the second end 38 of assembly 10. It is to be understood that since motor 46 operates with much less load than motor 47, it has been found unnecessary to monitor the condition of filter 14 at the first end 24, but such monitoring may be accomplished within the present invention, as well. Switch or sensor 112 has a pair of electrical contacts 96, 98 which are shown in a normally-open condition in FIG. 10. Leads 116 (see FIG. 2) extend from contacts 96, 98 and are preferably connected in series with leads 111 of indicator 110 and a source of electrical power to illuminate indicator 110 when contacts 96, 98 are closed, in a well-known manner. The switch 112 is to be set or calibrated via screw 118 such that the indicator remains OFF for filter blockage less than 50%, and ON for filter blockage greater than 75%, as measured by the percent of surface area blocked in the exposed face of filter 14 at the first air intake 22. It has been found that in the present embodiment filter blockages at the second end 38 of assembly 10 occurring at levels at and above 75% correspond to an unacceptable over temperature condition for motor 47. With the present embodiment, it has been found desirable to set the switch point somewhere in the range of 0.12 to 0.25 inches of water for a predetermined vacuum level or switch point to correspond to the operating condition of OFF @<50% blockage and ON@>75% blockage of the filter. Using a switch point in this range will enable proper operation over a range of input voltages while taking into account variations caused by the "open" and "closed" conditions of a non-bleeder type HVLP gun supplied with air from the turbine assembly 10. Furthermore, using a switch-point in this range has been found to provide a flickering or pulsing operation when the filter is partially blocked, i.e., within the range of 50 to 75% blockage (more particularly, when the vacuum sensed by switch 112 is near the predetermined vacuum level). Such flickering operation will alert the operator to the blockage of the filter and give an "early warning" of the indicator steady ON condition which calls for filter cleaning or replacement.

Figure 11:
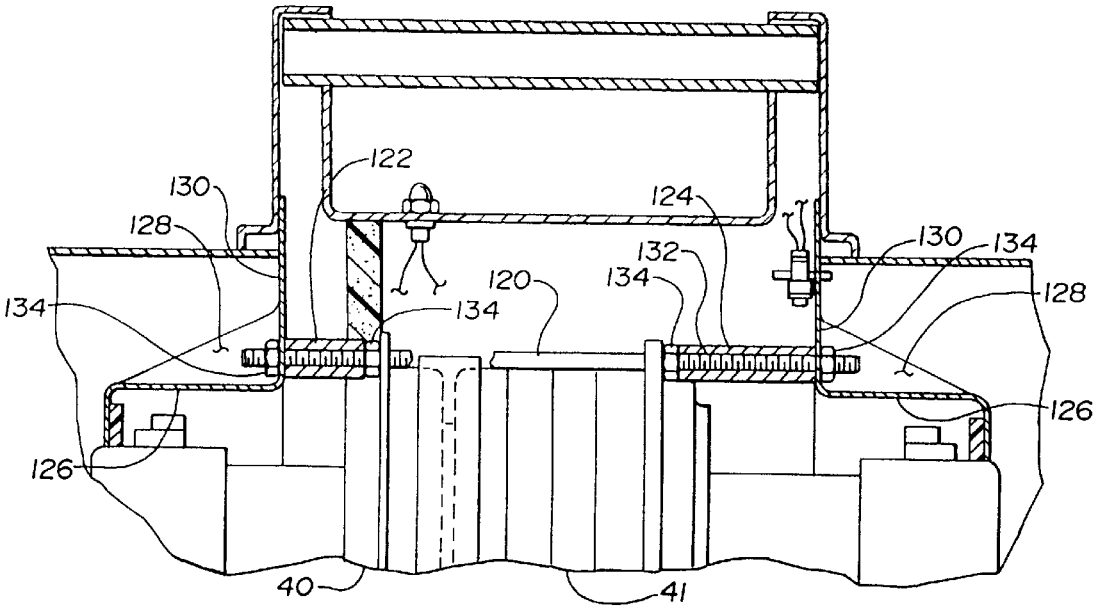
FIG. 11 is fragmentary section view of an alternative mounting arrangement for the turbines useful in the practice of the present invention.

The invention is not to be taken as limited to all of the details thereof as modifications and variations thereof may be made without departing from the spirit or scope of the invention. For example, the number of stages in one or both turbines may be varied while still remaining within the present invention. Furthermore, the mounting of the turbines may be by other than the tie rods and U-shaped bracket, provided that the outlet of the first turbine is kept immediately adjacent the inlet of the second turbine, to achieve the benefits of the present invention. Another alternative mounting arrangement for the turbines 40, 41 may be seen in FIG. 11. In this alternative mounting arrangement, the U-shaped bracket 70 is omitted and extended tie rods 120 are used to secure the turbines together and to a pair of modified motor support rings 126. Spacers 122, 124 are used to brace the turbines 40, 41 to rings 126. Rings 126 have a plurality of indentations 128 therein to form a corresponding plurality of ledges 130 having apertures to receive the extended tie rods 120. Each extended tie rod may have some or all of its length threaded as at 132 to receive nuts 134 to secure the turbines 40, 41 together and to mount it to the rings 126.

As a still further modification within the scope of the present invention, an audible indicator may be used in place of (or in addition to) indicator 110, provided that it is loud enough to be heard during operation of the turbine assembly 10.

What is claimed is:

1. In a portable turbine apparatus having an inlet air filter for providing air for use with paint spray guns, a filter blockage warning indicator assembly in combination therewith comprising:

a. an indicator having first and second states;

b. a vacuum sensor having i. a vacuum sensor port for sensing vacuum, the port in fluid communication with an air space downstream of the inlet filter, ii. a pair of electrical contacts having one of a closed and an open condition therebetween when vacuum sensed by the port is below a predetermined vacuum level and having the other of the closed and open condition when the vacuum sensed by the port is above the predetermined vacuum level; such that the indicator is placed in one of the first and second states via the contacts when the vacuum sensed is above the predetermined vacuum level to indicate that filter blockage is above a predetermined blockage level and the indicator is in the other of the first and second states when the vacuum sensed is below the predetermined vacuum level to indicate that filter blockage is below the predetermined blockage level.

2. The assembly of claim 1 wherein the portable turbine has at least one turbine and the air space is upstream of the one turbine.

3. The assembly of claim 1 wherein the portable turbine apparatus has a first and a second turbine therein and further wherein the air space is upstream of the second turbine.

4. The assembly of claim 3 wherein each turbine has a separate motor and the predetermined vacuum level corresponds to an unacceptable over temperature condition at the motor of the second turbine.

5. The assembly of claim 1 wherein the vacuum sensor further comprises means for adjusting the predetermined vacuum level at which the contacts change condition.

6. The assembly of claim 5 wherein the means for adjusting the predetermined vacuum level is set to cause the contacts to change condition at a filter blockage level between 50 and 75% blockage.

7. The assembly of claim 1 wherein the indicator pulses when the vacuum sensed by the vacuum sensor port is near the predetermined vacuum level.

8. The assembly of claim 1 wherein the indicator is a visual indicator.

9. The assembly of claim 1 wherein the indicator is an audible indicator.

10. The assembly of claim 1 wherein the one indicator condition indicates less than about fifty percent filter blockage.

11. The assembly of claim 10 wherein the other indicator condition indicates greater than about seventy five percent filter blockage.

* * * * *

US005772711B1

REEXAMINATION CERTIFICATE (3964th)

United States Patent [19] [11] B1 5,772,711

Kieffer [45] Certificate Issued Dec. 28, 1999

[54] FILTER BLOCKAGE WARNING INDICATOR

[75] Inventor: Joseph W. Kieffer, Rogers, Minn.

[73] Assignee: Wagner Spray Tech Corporation, Minneapolis, Minn.

Reexamination Request:
No. 90/005,243, Feb. 1, 1999

Reexamination Certificate for:

| | |
|---|---|
| Patent No.: | **5,772,711** |
| Issued: | **Jun. 30, 1998** |
| Appl. No.: | **08/753,830** |
| Filed: | **Dec. 2, 1996** |

Related U.S. Application Data

[62] Division of application No. 08/498,739, Jul. 6, 1995, Pat. No. 5,639,222.

[51] Int. Cl.[6] ..... B01D 35/143

[52] U.S. Cl. ..... 96/418; 55/471; 95/19; 95/25; 96/419; 96/421; 417/63

[58] Field of Search ..... 73/38; 15/339; 210/90; 116/70; 340/607, 626; 96/417–419, 421

[56] References Cited

U.S. PATENT DOCUMENTS

| | | | |
|---|---|---|---|
| 2,057,904 | 10/1936 | Morse | 251/126 |
| 2,499,494 | 3/1950 | Greer | 210/90 |
| 3,587,515 | 6/1971 | Anderson | 116/70 |
| 4,040,042 | 8/1977 | Mayer | 55/DIG. 34 |
| 4,193,292 | 3/1980 | Simonsson | 73/38 |
| 4,233,597 | 11/1980 | Kurz | 340/626 |
| 4,481,692 | 11/1984 | Kurz | 15/339 |
| 4,492,151 | 1/1985 | Mattei | 454/70 |
| 4,701,193 | 10/1987 | Robertson et al. | 55/217 |
| 4,940,747 | 7/1990 | Larsson et al. | 55/210 |
| 5,204,156 | 4/1993 | Asano et al. | 73/38 |
| 5,351,035 | 9/1994 | Chrisco | 340/607 |

OTHER PUBLICATIONS

MPL Product Brochure pp. 2–6, Sep. 2, 1998.

Sears Owners Manual Kenmore Canister Vacuum Cleaner Model 116.27455, Apr. 1988.

*Primary Examiner*—Richard L. Chiesa

[57] ABSTRACT

Apparatus for indicating when the air intake filter of portable turbines useful with spray paint guns is blocked and a method and apparatus for close coupled mounting of a pair of series connected turbines by axially aligning and abutting the axial outlet of one turbine against the axial inlet of the other turbine with a seal surrounding the turbine junction and with tie rods extending between radially projecting apertured ears of the turbines securing the turbines together and supporting the turbines on a generally U-shaped mounting bracket having spaced apart flanges engaging the tie rods. An air baffle partitions the space containing the two turbines into two air plenums to prevent hot air exhausted by the larger turbine from entering the air inlet to the turbine impellers. A visual or audible indicator provides a perceptible indication that the filter is becoming blocked.

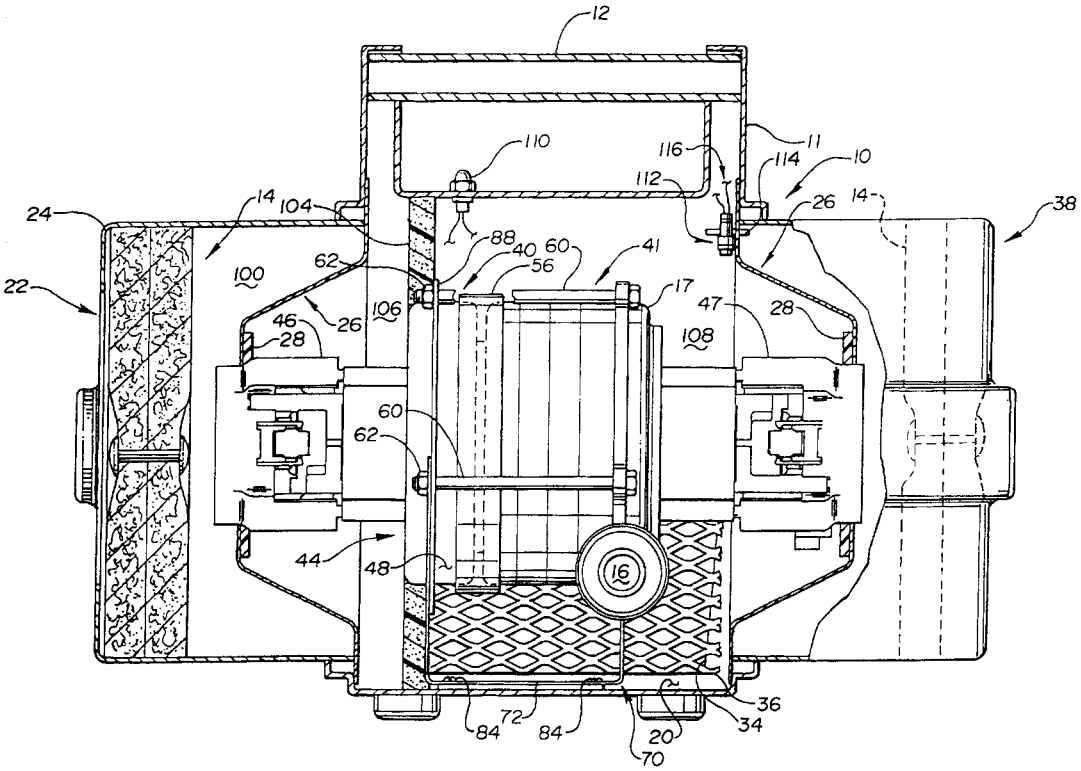

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claim 1 is determined to be patentable as amended.

Claims 3–11, dependent on an amended claim, are determined to be patentable.

1. In a portable turbine apparatus having an inlet air filter for providing air for use with paint spray guns, a filter blockage warning indicator assembly in combination therewith comprising:

*a turbine apparatus including:*

*a motor;*

*a turbine driven by the motor for providing pressurized air at an outlet for atomizing paint;*

*an inlet airflow path upstream of the turbine for delivering air to the turbine;*

*a motor cooling airflow path upstream of the motor; and*

*an indicator assembly including:*

[a.] an indicator having first and second states;

[b.] a vacuum sensor having

[i.] a vacuum sensor port for sensing vacuum, the port in fluid communication with an air space *in the cooling airflow path* downstream of the inlet filter,

[ii.] a pair of electrical contacts having one of a closed and an open condition therebetween when vacuum sensed by the port is below a predetermined vacuum level and having the other of the closed and open condition when the vacuum sensed by the port is above the predetermined vacuum level; such that the indicator is placed in one of the first and second states via the contacts when the vacuum sensed is above the predetermined vacuum level to indicate that filter blockage is above a predetermined blockage level and the indicator is in the other of the first and second states when the vacuum sensed is below the predetermined vacuum level to indicate that filter blockage is below the predetermined blockage level.

* * * * *